US012281276B2

(12) United States Patent
Bonta et al.

(10) Patent No.: US 12,281,276 B2
(45) Date of Patent: Apr. 22, 2025

(54) STRUCTURED ASSEMBLY LUBRICANT

(71) Applicant: VGP IPCO LLC, Lexington, KY (US)

(72) Inventors: Jacob Bonta, Berea, KY (US); James Brown, Lexington, KY (US); Lucas Tomko, Lexington, KY (US)

(73) Assignee: VGP IPCO LLC, Lexington, KY (US)

( * ) Notice: Subject to any disclaimer, the term of this patent is extended or adjusted under 35 U.S.C. 154(b) by 0 days.

(21) Appl. No.: 18/364,831

(22) Filed: Aug. 3, 2023

(65) Prior Publication Data

US 2024/0043764 A1 Feb. 8, 2024

Related U.S. Application Data

(60) Provisional application No. 63/370,542, filed on Aug. 5, 2022.

(51) Int. Cl.

| | |
|---|---|
| ***C10M 101/02*** | (2006.01) |
| *C10N 30/06* | (2006.01) |
| *C10N 40/00* | (2006.01) |
| *C10N 40/04* | (2006.01) |
| *C10N 40/25* | (2006.01) |
| *C10N 50/02* | (2006.01) |

(52) U.S. Cl.

CPC .. *C10M 101/025* (2013.01); *C10M 2203/003* (2013.01); *C10M 2203/1006* (2013.01); *C10N 2030/06* (2013.01); *C10N 2040/042* (2020.05); *C10N 2040/044* (2020.05); *C10N 2040/25* (2013.01); *C10N 2040/40* (2020.05); *C10N 2050/02* (2013.01)

(58) Field of Classification Search

CPC ..... C10M 101/025; C10M 2203/003; C10M 2203/1006; C10M 171/00; C10M 2205/166; C10M 169/04; C10N 2030/06; C10N 2040/042; C10N 2040/044; C10N 2040/25; C10N 2040/40; C10N 2050/02; C10N 2040/04; C10N 2040/14; C10N 2070/00

See application file for complete search history.

(56) References Cited

U.S. PATENT DOCUMENTS

| | | | | |
|---|---|---|---|---|
| 4,670,174 | A * | 6/1987 | Mirkin | C10M 101/025 508/491 |
| 4,725,493 | A * | 2/1988 | Hoffmann | B41M 5/10 503/227 |
| 8,480,879 | B2 | 7/2013 | Rosenbaum et al. | |
| 8,771,119 | B2 | 7/2014 | Tanaka | |
| 8,912,282 | B2 | 12/2014 | Soediono et al. | |
| 10,920,161 | B2 | 2/2021 | Patil et al. | |
| 2007/0149422 | A1* | 6/2007 | Miyajima | C10M 159/06 508/552 |
| 2009/0258802 | A1* | 10/2009 | Hagan | F16C 33/10 508/591 |

(Continued)

OTHER PUBLICATIONS

International Search Report and Written Opinion issued in PCT application No. PCT/US23/71597, Feb. 21, 2024.

*Primary Examiner* — Ellen M McAvoy

(74) *Attorney, Agent, or Firm* — Benesch Friedlander Coplan & Aronoff LLP

(57) ABSTRACT

A two-phase structured lubricant includes a liquid component about 5% by weight (wt. %) to 95 wt. %, and a structural component about 5 wt. % to 95 wt. %. The structural component recrystallizes or solidifies around the liquid component.

20 Claims, 3 Drawing Sheets

(56) References Cited

U.S. PATENT DOCUMENTS

| | | | | |
|---|---|---|---|---|
| 2010/0248879 | A1* | 9/2010 | Tanaka | C10M 169/02 474/206 |
| 2017/0183603 | A1* | 6/2017 | Imai | C10M 169/044 |
| 2017/0275558 | A1* | 9/2017 | Saito | C10M 143/02 |
| 2019/0218473 | A1* | 7/2019 | Cassidy | C10M 159/06 |
| 2020/0231814 | A1* | 7/2020 | Golec | F16G 13/00 |
| 2021/0301215 | A1 | 9/2021 | Conner | |
| 2022/0073838 | A1* | 3/2022 | Wong | C10M 107/02 |

* cited by examiner

STRUCTURED ASSEMBLY LUBRICANT

CROSS-REFERENCE TO RELATED APPLICATIONS

The present application claims the benefit of priority under 35 U.S.C. § 119 from U.S. Provisional Patent Application No. 63/370,542 entitled "Structured Assembly Lubricant," filed on Aug. 5, 2022, the disclosure of which is hereby incorporated by reference in its entirety for all purposes.

RELATED TECHNOLOGY

The present disclosure relates to lubricants, and more specifically relates to lubricants for assembly applications.

BACKGROUND

Lubricants are often used in assembly and/or repair applications. For example, an assembly lubricant is used to provide lubrication and reduce the friction between parts. The lubricity provided by the assembly lubricant is gone after certain amount of time or the assembly lubricant is removed, such that the parts no longer slide easily across one another. Challenges are faced in engineering high performance lubricants that are compatible with a variety of assemblies, e.g., combustion engines, manual transmission systems, automatic transmission systems, transfer cases (for vehicle), differential gear systems, gear systems, electrical vehicles, electric vehicle transmission systems, etc.

SUMMARY

In one embodiment, a two-phase structured lubricant includes a liquid component about 5% by weight (wt. %) to 95 wt. %, and a structural component about 5 wt. % to 95 wt. %. The structural component recrystallizes or solidifies around the liquid component.

In one embodiment, a method of making a two-phase structured lubricant includes mixing and heating a liquid component, about 5 wt. % to 95 wt. % of the two-phase structured lubricant. The method includes mixing a structured component with the heated liquid component. The structural component is about 5 wt. % to 95 wt. % of the two-phase structured lubricant. The method includes melting the structural component and mixing with the liquid component to form a homogenous mixture. The method further includes cooling the homogeneous mixture to form the two-phase structured lubricant.

In another embodiment, a method of assembling a system using a two-phase structured lubricant includes applying the two-phase structured lubricant to assembly a system and applying a standard lubricant to the assembled system. The two-phase structured lubricant includes a liquid component about 5% by weight (wt. %) to 95 wt. % and a structural component about 5 wt. % to 95 wt. %. The structural component recrystallizes or solidifies around the liquid component.

DETAILED DESCRIPTION

Figure 1:
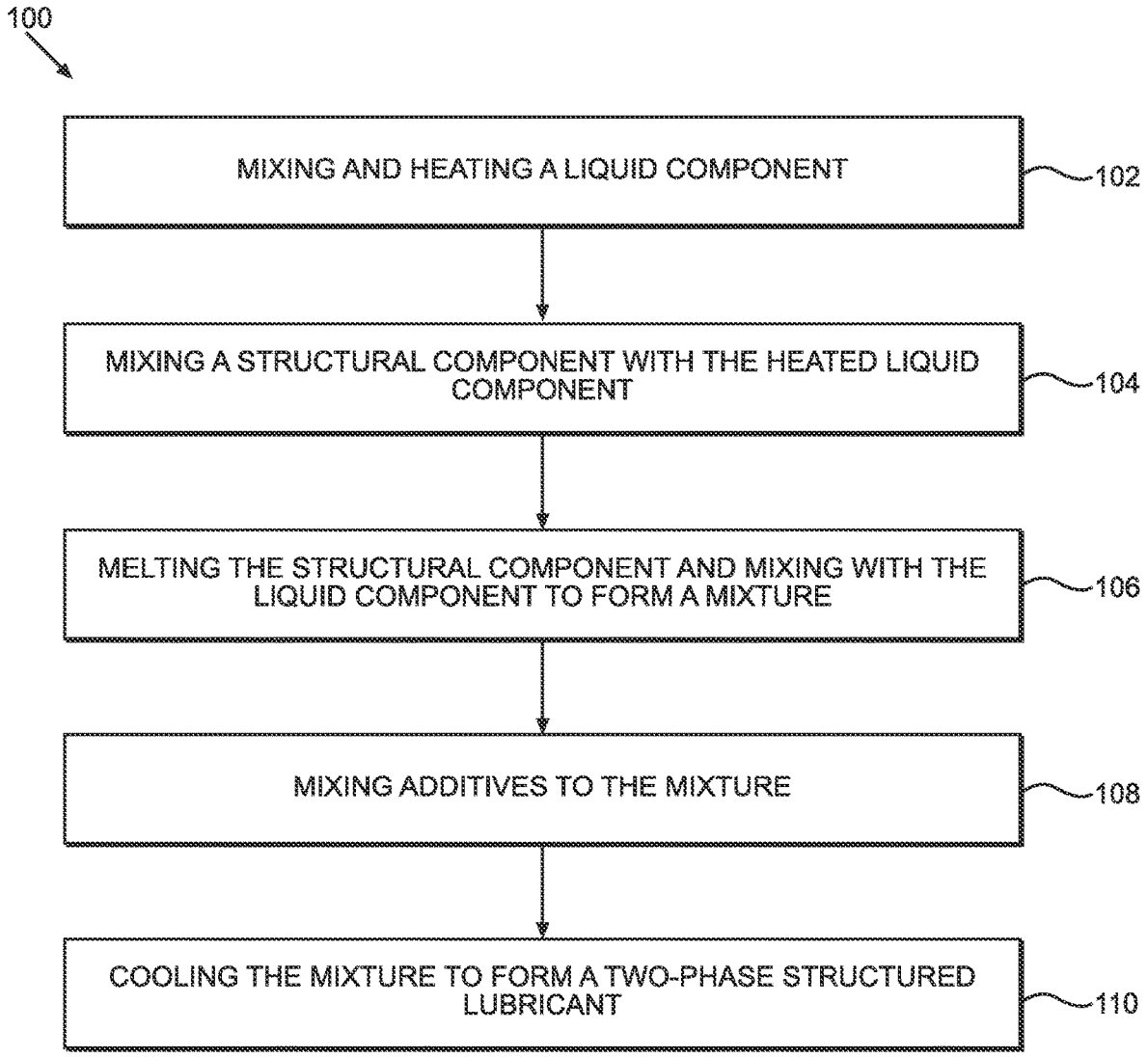
FIG. 1 shows an example method of making two-phase structured lubricants disclosed herein.

The present disclosure is directed to compositions and methods for making structured lubricants with desirable properties for use in a variety of assemblies of lubricated engineering components such as combustion engines, manual/automatic transmission systems, transfer cases, and differential gearing, to aid in the assembly process and to provide lubrication during the initial startup of these systems.

The lubricants disclosed herein are designed to provide a viscous, semi-solid structure that aids in assembly of the system by adhering to components and holding them in place.

The lubricants disclosed herein are designed to provide tribological and corrosion protection of components during shipping or storage before initial startup.

The lubricants disclosed herein are designed to provide tribological protection of the assembled components during their initial startup to prevent excessive wear or damage of components.

The lubricants disclosed herein are designed to have characteristics and/or properties that allow for the rapid displacement of the lubricant by the standard lubricant present in the system (e.g., the system assembled using the lubricants disclosed herein). A standard lubricant refers to the lubricant conventionally used to provide lubrication during the operation the system (e.g., the system assembled using the lubricants disclosed herein).

The lubricants disclosed herein are designed to have minimal or negligible impacts on the performance properties of the standard lubricant or lubricating system.

Additionally, modern electric vehicle (EV) transmission systems often house sensitive electrical components in addition to their gearing systems. Lubricants for these applications are designed with a very low level of electrical conductivity as a safety factor in preventing short-circuit or other hazardous conditions. The lubricants disclosed herein are designed to provide enhanced tribological protection of components during startup without significant impacts to the electrical conductivity of the standard lubricant for the system.

The lubricant system disclosed herein is composed of two phases; a liquid phase composed of lubricating base oil and a solid phase that provides structure to the system. It is desirable in this system to have a structural phase that provides high viscosity and low temperature and shear rate but demonstrates extreme shear thinning behavior as well as possesses a distinct melting point below the normal operating temperature of the system.

The system is made by first blending the lubricant base component(s) together under mild heating, along with desired additives to improve performance. Next the structural phase is formed by addition of a crystalline, hydrocarbon wax, and/or petrolatum and heating until the system forms a single phase, homogeneous system. The system is then cooled to allow recrystallization of the wax distributed throughout the lubricant base component(s). Upon completion a firm, malleable material is formed that exhibits the desired properties including extreme shear thinning behavior, improved tribological performance, no/minimal impact on electrical conductivity, and well-defined melting point.

Formulation of the Lubricants

The lubricant system disclosed herein includes two phases, a liquid phase composed of lubricating base oil and a solid phase or a structural phase that provides a structure to the lubricant system. It is desirable in the lubricant system disclosed herein to have a structural phase that provides a high viscosity and a high shear rate at low temperatures while demonstrates extreme shear thinning behavior and has a distinct melting point below the normal operating temperature of the system.

Table 1 shows examples of two-phase structured lubricants disclosed herein. These materials include a solid structural component and a liquid lubricant component.

TABLE 1

| | Structural Component | Liquid Component |
|---|---|---|
| Formulation I | Wax, about 5 wt. % to 30 wt. % | Lubricant oil, about 70 wt. % to 95 wt. % |
| Formulation II | Petrolatum, about 75 wt. % to 95 wt. % | Lubricant oil, about 5 wt. % to 25 wt. % |

Formulation I includes wax about 5 weight percent (wt. %) to about 30 wt. % (e.g., solid structural component) and lubricant oil about 70 wt. % to about 95 wt. % (e.g., liquid lubricant component). In some aspects of the invention, a formulation including the structural component is a wax present in an amount from about 1 wt. % to about 35 wt. %, and a lubricant oil present in an amount from about 65 wt. % to about 99 wt. %, with the sum of the structural component and liquid component totaling 100%. In some aspects the formulation I includes the structural component that is a wax present in an amount from about 5 wt. % to about 30 wt. %, and a lubricant oil that is a liquid component present in an amount from about 70 wt. % to about 95 wt. %, with the sum of the structural component, liquid component, and additives (including friction reducers, anti-wear agents, extreme pressure (EP) agents, corrosion inhibitors, and oxidation inhibitors for example) totals 100%. In some aspects of the invention, a formulation including the structural component that is a wax present in an amount from 5 wt. % to 35 wt. %, and a lubricant oil present in an amount from 70 wt. % to 95 wt. %, with the sum of the structural component, liquid component, and any additional additives totaling 100%. Of course in some aspects of the invention, the formulation includes the structural component is a wax present in an amount that is a single number present in the range from about 5 wt. % to about 30 wt. %, such as 25 wt. % and a lubricant oil present is a single number present in the range from about 65 wt. % to about 95 wt. %, such as 75 wt. %. In yet another aspect of the invention of Formulation I, a wax present in an amount that is a single number present in the range from about 5 wt. % to about 30 wt. %, such as 20 wt. %, a lubricant oil present is a single number present in the range from about 65 wt. % to about 95 wt. %, such as 70 wt. %, and up to 10 wt. % additives such as friction reducers, anti-wear agents, extreme pressure (EP) agents, corrosion inhibitors, or oxidation inhibitors, is added to Formulation I so that the sum of all components is 100 wt. % Formulation II includes petrolatum about 75 wt. % to about 95 wt. % (e.g., solid structural component) and lubricant oil about 5 wt. % to about 25 wt. % (e.g., liquid lubricant component). In some aspects of the invention, a formulation including the structural component is a petrolatum present in an amount from about 70 wt. % to about 99 wt. %, and a lubricant oil present in an amount from about 1 wt. % to about 30 wt. %, with the sum of the structural component and liquid component totaling 100%. In some aspects the formulation II includes the structural component that is a petrolatum present in an amount from about 75 wt. % to about 95 wt. %, and a lubricant oil that is a liquid component present in an amount from about 5 wt. % to about 25 wt. %, with the sum of the structural component, liquid component, and additives (including friction reducers, anti-wear agents, extreme pressure (EP) agents, corrosion inhibitors, and oxidation inhibitors for example) totals 100%. In some aspects of the invention, a formulation including the structural component that is a petrolatum present in an amount from 75 wt. % to 95 wt. %, and a lubricant oil present in an amount from 5 wt. % to 25 wt. %, with the sum of the structural component, liquid component, and any additional additives totaling 100%. Of course in some aspects of the invention, the formulation includes the structural component is a petrolatum present in an amount that is a single number present in the range from about 75 wt. % to about 95 wt. %, such as 80 wt. % and a lubricant oil present is a single number present in the range from about 5 wt. % to about 25 wt. %, such as 20 wt. %. In yet another aspect of the invention of Formulation II, a petrolatum present in an amount that is a single number present in the range from about 75 wt. % to about 95 wt. %, such as 70 wt. %, a lubricant oil present is a single number present in the range from about 5 wt. % to about 25 wt. %, such as 20 wt. %, and 10 wt. % additives such as friction reducers, anti-wear agents, extreme pressure (EP) agents, corrosion inhibitors, or oxidation inhibitors is added to the formulation, so that the sum of all components is 100 wt. %

The wax in Formulation I may be metastable crystalline hydrocarbon based wax made of synthetic and/or natural wax, such as rice bran wax, carnauba wax, polyethylene wax, polypropylene wax, etc.

The petrolatum in Formulation II may be modified refined petrolatum made from commercially sourced petrolatum derived from the heavy oil/wax blends generated during oil refinement.

The lubricant oil in Formulations I and II may be any hydrocarbon lubricant oils selected based on performance and compatibility with the system of interest. For example, the lubricant oil may be hydrocarbon lubricant oils, such as the American Petroleum Institute (API) developed Groups I-V oils, silicone oils, fluorinated oils, etc.

In addition to the core components (the solid structural component and the liquid lubricant component), the two-phase structured lubricants disclosed herein may include additives and/or colorants based on the requirements of the system. For example, Formulation I and/or Formulation II may include colorants and/or performance enhancing additives to increase the tribological performance, oxidation resistance, or corrosion prevention properties, etc.

The use of colorants may vary significantly to provide a color to differentiate the two-phase structured lubricants disclosed herein from common lubricants. The colorants may include oil soluble organic and/or various inorganic chemical compounds. The colorants may be about 0.01 wt. % to 0.05 wt. % of the two-phase structured lubricants disclosed herein.

The additives may include one or more of the following: friction reducers, anti-wear agents, extreme pressure (EP) agents, corrosion inhibitors, and oxidation inhibitors.

Friction reducers may be about 0.01 wt. % to 5 wt. % of the two-phase structured lubricants disclosed herein. The friction reducers include one or more of: organic modifiers (long chain esters, alkanolamindes and variations based on C, N, O and H elements), molybdenum dialkyldithiophosphates and derivatives, olybdenum dithiocarbamates and derivatives, antimony dithiocarbamates, dimercaptothiadiazoles and derivatives, tungsten dialkyldithiophosphates and derivatives, ashless phosphorodithioates, and amine phosphates and derivatives.

Anti-wear agents may be about 0.01 wt. % to 5 wt. % of the two-phase structured lubricants disclosed herein. The anti-wear agents include one or more of: zinc dialkyldithiophosphates or ZDDP (primary, secondary, mixed), dithiophosphates, amine sulfurized dithiophosphates, polysulfides, phosphoric acid esters, dialkyldithiocarbamates, dialkylammonium tungstates, borate esters, amine phosphates, and organosulfur-phosphates.

EP agents may be about 0.01 wt. % to 5 wt. % of the two-phase structured lubricants disclosed herein. The EP agents include one or more of: calcium carbonates, molybdenum disulfides, dithiophosphates, amine sulfurized phosphates/phosphites, sulfurized isobutylene and derivatives, sulfurized olefins and derivatives, sodium/potassium borate salts, zinc dithiophosphates, sulfurized Fatty acid esters, sulfurized triglycerides, dialkylpentasulfides, antimony dialkyldithiocarbamates and derivatives, amine phosphates and derivatives, thiadiazole derivatives, organic dibutyldithiocarbamates and derivatives, and calcium sulfonates and derivatives.

Corrosion inhibitors may be about 0.01 wt. % to 5 wt. % of the two-phase structured lubricants disclosed herein. The corrosion inhibitors include one or more of: amine carboxylates, borate caboxylates, alkyl phosphates, pyridine benzyl quaternary ammonium compounds, imidazolines, calcium sulfonates, hydroxy-amino phosphoric acids, and benzotriazole/tolytriazoles.

Oxidation inhibitors may be about 0.01 wt. % to 5 wt. % of the two-phase structured lubricants disclosed herein. The oxidation inhibitors include one or more of phenolic antioxidants, aryl amines, and butylated phenols.

In some embodiments, the two-phase structured lubricant may include a combination of Formulation I and Formulation II. For example, the two-phase structured lubricant disclosed herein may include a structural component (wax and/or petrolatum) about 5 wt. % to 95 wt. % and a liquid component (lubricant oil) about 5 wt. % to 95 wt. %.

Batching Process

FIG. 1 shows an example method (100) of making a two-phase structured lubricant based on formulations shown in Table 1. The method 100 includes mixing and heating a liquid component (step 102). For making a two-phased structured lubricant based on Formulation I, the amount of lubricant oil added to a container is pre-determined such that the amount of lubricant oil is about 70 wt. % to 95 wt. % of the two-phase structured lubricant. For making the two-phased structured lubricant based on Formulation II, the amount of lubricant oil added to a container is pre-determined such that the amount of lubricant oil is about 5 wt. % to 25 wt. % of the two-phase structured lubricant. The container may be any suitable vessels for mixing and applying heat to the substance contained thereto. For example, the container may be a mixer or a vessel with an agitator blade and the container is coupled to or equipped with a heating element to apply heat to the substance contained therein.

The liquid component (the lubricant oil) is mixed at any suitable rate to achieve effective mixing. The mixing rate may be based on the material and quantity of the substance in the container, the size of the mixer/agitator blade, the size of the container, etc. The mixing rate may be about 400 revolutions per minute (rpm) to 1000 rpm, about 500 rpm to 900 rpm, about 600 rpm to 800 rpm, about 650 rpm to 750 rpm, or about 700 rpm.

The liquid component (lubricant oil) is heated to a temperature equal to or a few degrees higher, e.g., about 1 degree Celsius (° C.) to 10° C. higher, about 1° C. to 5° C. higher, or about 3° C. higher, than the melting temperature of the structural component of the two-phase structured lubricant.

For making the two-phase structured lubricant based on Formulation I, the structural component is wax, which may have a melting temperature about 45° C. to 125° C., about 50° C. to 115° C., about 65° C. to 105° C., about 75° C. to 95° C., or about 85° C.; therefore in step 102, the liquid component (lubricant oil) is heated to a few degrees higher than about 45° C. to 125° C., about 55° C. to 115° C. , about 65° C. to 105° C., about 75° C. to 95° C., or about 85° C.

For making the two-phase structured lubricant based on Formulation II, the structural component is petrolatum, which may have a melting temperature about 20° C. to 100° C., about 30° C. to 90° C., about 40° C. to 80° C., about 50° C. to 70 ° C., or about 60° C.; therefore in step 102, the liquid component (lubricant oil) is heated to a few degrees higher than 20° C. to 100° C., about 30° C. to 90° C., about 40° C. to 80° C., about 50° C. to 70° C., or about 60° C.

The method 100 includes mixing a structural component with the heated liquid component (step 104). For making the two-phase structured lubricant based on Formulation I, the amount of wax mixed with the heated liquid component (lubricant oil) is pre-determined such that the amount of wax is about 5 wt. % to 30 wt. % of the two-phase structured lubricant. For making the two-phase structured lubricant based on Formulation II, the amount of wax of Formulation II added is pre-determined such that the amount of petrolatum is about 75 wt. % to 95 wt. % of the two-phase structured lubricant.

The method 100 includes melting the structural component and mixing with the liquid component to form a mixture (step 106). The applied heat in step 102 is maintained to melt the structural component (wax in Formulation I and petrolatum in Formulation II) added in step 104. The structural component and the liquid component (lubricant oil) are mixed at any suitable rate to achieve effective mixing to form a single phase system (a homogeneous mixture). The single phase system (a homogeneous mixture) formed in step 106 may have a relatively clear or transparent appearance. The mixing rate may be based on the quantity of the substances (the structural component and the lubricant component), the relative ratio of the substances in the container, the size of the mixer/agitator blade, the size of the container, etc. The mixing rate may be about 400 rpm to 1000 rpm, about 500 rpm to 900 rpm, about 600 rpm to 800 rpm, about 650 rpm to 750 rpm, or about 700 rpm. The time duration of heating and mixing in step 106 may be any effective duration to form a single phase system (a homogeneous mixture). The time duration of heating and mixing in step 106 may depend on the material and quantity of the substances (the structural component and the liquid component), the relative ratio of the substances in the container, the size of the mixer/agitator blade, the size of the container, etc.

The method 100 may include mixing additive(s) to the mixture (step 108). The amount of additive(s) and/or colorant(s) added is based on pre-determined calculation such that the amount of additive(s) is about 0.01 wt. % to 5 wt. % and/or the amount of colorant(s) is about 0.01 wt. % to 0.05 wt. % of the two-phase structured lubricant. The additive(s) and/or colorant(s) may be added in step 102, 104, or 106 such that the additive(s) and/or colorant(s) form a single phase system (a homogeneous mixture) with the liquid component and the structural component. In some embodiments, step 108 may be omitted.

The method 100 includes cooling the mixture to form a two-phase structured lubricant (step 110). Once the single phase system (homogeneous mixture) is formed, the heating and mixing is ceased and the mixture is cooled to room temperature at an effective cooling rate such that the mixture forms a two-phase structured lubricant. For Formulation I, the wax in the mixture recrystallizes around the lubricant oil phase, resulting in a two-phase structured lubricant having high stiffness and viscosity. For Formulation II, as the mixture cools, the waxy components solidify and dominate the character of the mixture, resulting in a stiff two-phase structured lubricant.

The cooling rate may be based on the material and quantity of the substances (the liquid component and the structural component), the relative ratio of the substances in the container, the size of the container, etc. The mixture may be cooled naturally or may be cooled with assisted cooling methods, e.g., convection cooling, conduction cooling. The cooling in step 110 may be about 1° C. to 5° C. per minute.

The two-phase structured lubricant prepared by method 100 is metastable, exhibiting structural and thermal properties significantly different from the single component (e.g., only liquid component or only structural component). The two-phase structured lubricant prepared by method 100 has a significantly suppressed melting point (e.g., as compared to the single component) and exhibits extreme shear thinning behavior.

Test Results

Formulations shown in Table 1 are evaluated by tribological tests and by measuring the effect on electrical conductivity.

Table 2 show structural stability data of the two-phase structured lubricant formulations shown in Table 1 (e.g., Formulation I and Formulation II) tested based on ASTM D217 (0 work and 60 work), ASTM D1831 (roll stability), and melting temperature measured based on differential scanning calorimetry (DSC).

TABLE 2

| Formula | ASTM D217 0 Work | ASTM D217 60 Work | ASTM D1831 Roll Stability | Melting Points (DSC Method) |
|---|---|---|---|---|
| Formulation I | 215 mm/10 | 425 mm/10 | Liquid | 65° C. |
| Formulation II | 220 mm/10 | 235 mm/10 | 266.5 mm/10 | 40° C. |

In particular, the lubricating grease consistency of the two-phase structured lubricants disclosed herein is tested using ASTM D217 (standard test methods for cone penetration of lubricating grease). The ASTM D217 test results for Formulation I at zero penetration work and at 60 strokes penetration work are 215 in 0.1 millimeter (mm/10) and 425 mm/10, respectively. The ASTM D217 test results for Formulation II zero penetration work and at 60 strokes penetration work are 220 mm/10 and 235 mm/10, respectively.

The changes in the consistency of the two-phase structured lubricants disclosed herein are tested using ASTM D1831 (standard test method for roll stability of lubricating grease). The ASTM D1831 test results for Formulation I is liquid. The ASTM D1831 test results for Formulation II is 266.5 mm/10.

The melting temperatures measured based on DSC are 65° C. and 40° C. for Formulations I and II, respectively.

Table 3 show tribological data of the two-phase structured lubricant formulations shown in Table 1 (e.g., Formulation I and Formulation II) tested based on ASTM D2266 (wear scar), ASTM D2596 (last non-seizure load and weld load), ASTM D5706 (pass load), and ASTM D7594 (wear scar/coefficient of friction).

TABLE 3

| Formula | ASTM D2266 wear scar | ASTM D2596 last nonseizure load | ASTM D2596 weld load | ASTM D5706 pass load | ASTM D7594 wear scar/cof |
|---|---|---|---|---|---|
| Formulation I | 0.39 mm | 63 kg | 200 kg | 2000 N | 0.486 mm/0.128 |
| Formulation II | 0.43 mm | 126 kg | 200 kg | 2000 N | 0.562 mm/0.119 |

In particular, the wear preventive characteristics of the two-phase structured lubricants disclosed herein are tested using ASTM D2266 (standard test method for wear preventive characteristics of lubricating grease, four-ball method). The ASTM D2266 test results for Formulations I and II are 0.39 mm and 0.43 mm, respectively.

The load-carrying properties of the two-phase structured lubricants disclosed herein are tested using ASTM D2596 (standard test method for measurement of extreme pressure properties of lubricating grease, four-ball method). The ASTM D2596 last nonseizure loads for Formulations I and II are 63 kilogram (kg) and 126 kg, respectively. The ASTM D2596 weld points for Formulations I and II are both 200 kg.

The extreme pressure properties of the two-phase structured lubricants disclosed herein are tested using ASTM D5706 (standard test method for determining extreme pressure properties of lubricating grease using a high-frequency, linear-oscillation test machine). The ASTM D5706 pass loads for Formulations I and II are both 2000 Newton (N).

The anti-wear properties and coefficient of friction of the two-phase structured lubricants disclosed herein are tested using ASTM D7594 (fretting wear resistance of lubricating greases under high Hertzian contact pressures using a high-frequency, linear oscillation). The ASTM D7594 test results for Formulations I and II are 0.486 mm/0.128 and 0.562 mm/0.119, respectively.

Table 4 show fluid compatibility data of the two-phase structured lubricant formulations shown in Table 1 (e.g., Formulation I and Formulation II) diluted by a standard electrical vehicle transmission fluid at a ratio of two-phase structured lubricant : standard electrical vehicle transmission fluid=50:1 parts. The fluid compatibility data are tested based on high frequency reciprocating rig (HFRR) tests (friction test and wear scar area test), ASTM D2266 (wear scar), and electrical conductivity test (at 25° C.). These tests are done based on diluted formulations to show the effects of the two-phase structured lubricant formulations on the native lubricant's properties.

TABLE 4

| Formula | HFRR friction | HFRR wear scar area | ASTM D2266 wear scar | Electrical Conductivity (25° C.) |
|---|---|---|---|---|
| EV Base Fluid | 0.115 | 19767 $mm^2$ | 0.41 mm | 4300 pS/cm |
| Formulation I | 0.106 | 11242 $mm^2$ | 0.459 mm | 6000 pS/cm |
| Formulation II | 0.128 | 22066 $mm^2$ | 0.51 mm | 6800 S/cm |

In particular, the measurement for lubrication of the two-phase structured lubricants disclosed herein and of a conventional electric vehicle (EV) base fluid are done using HFRR tests. The coefficients of friction measured by HFRR tests for Formulations I and II and a conventional EV base fluid are 0.106, 0.128, and 0.115, respectively. The wear scar areas measured by HFRR tests for Formulations I and II and a conventional EV base fluid are 11242 millimeter square ($mm^2$), 22066 $mm^2$, and 19767 $mm^2$, respectively.

The extreme pressure properties of the two-phase structured lubricants disclosed herein and a conventional EV base fluid are tested using ASTM D2266 (standard test method for wear preventive characteristics of lubricating grease, four-ball method). The ASTM D2266 wear scars for Formulations I and II and a conventional EV base fluid are 0.459 millimeter (mm), 0.51 mm, and 0.41 mm, respectively.

The electrical conductivities measured at 25° C. for Formulations I and II and a conventional EV base fluid are 6000 picosiemens/centimeter (pS/cm), 6800 pS/cm, and 4300 pS/cm, respectively.

Based on the data shown in Table 4, the properties of the two-phase structured lubricants disclosed herein are highly compatible with the conventional EV base fluid.

Figure 2:
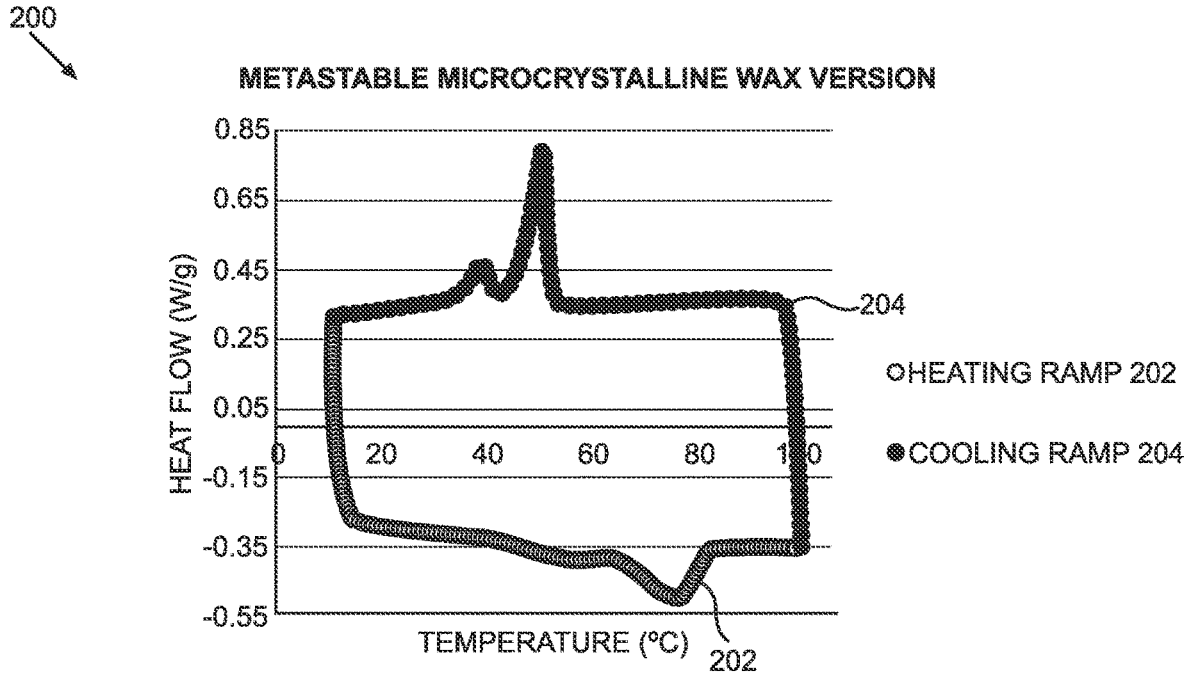
FIG. 2 shows an example structural analysis results for the two-phase lubricants disclosed herein.
Figure 2:
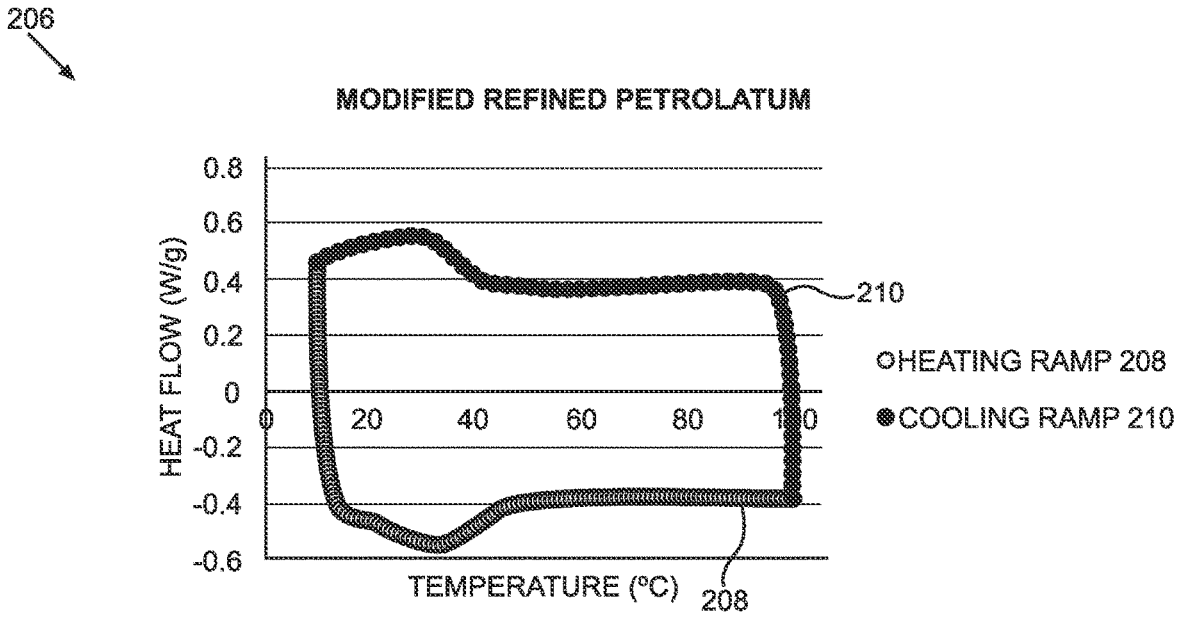

FIG. 2 shows an example structural analysis results of the two-phase structured lubricant formulations disclosed herein. Chart 200 shows a DSC spectrum of the two-phase structured lubricant based on Formulation I. Series 202 and 204 show the heating ramp and cooling ramp, respectively. The sharp peaks in the DSC spectrum indicate a crystalline characteristic of the two-phase structured lubricant. In particular, the sharp melting and freezing peaks indicate a higher level of regular order and crystallinity.

Chart 206 shows a DSC spectrum of the two-phase structured lubricant based on Formulation II. Series 208 and 210 show the heating ramp and cooling ramp, respectively. The broad peaks in the DSC spectrum indicate a meta-stable semi-solid characteristic of the two-phase structured lubricant. In particular, the broad melting and freezing peaks indicate a waxy phase change.

Figure 3:
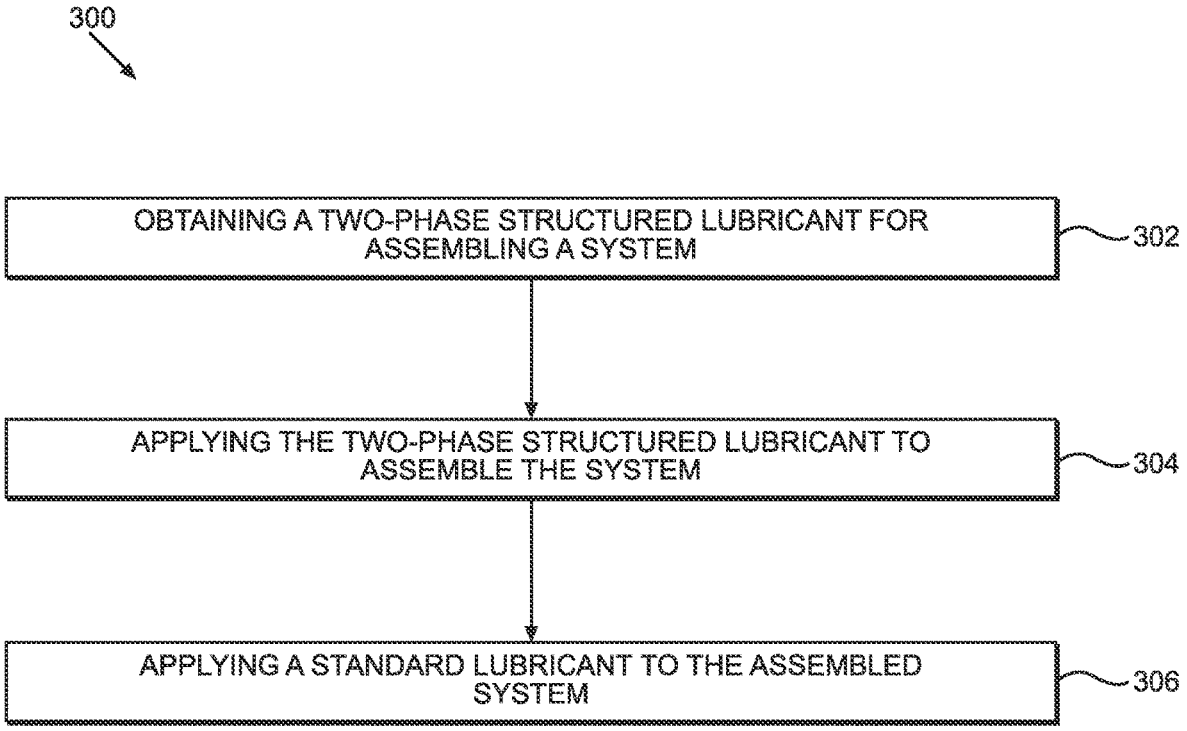
FIG. 3 shows an example method of using the two-phase structured lubricants disclosed herein.

FIG. 3 shows an example method 300 of using the two-phase structured lubricant disclosed herein in a system. Method 300 includes obtaining a two-phase structured lubricant for assembling a system (step 302). The two-phase structured lubricant can be obtained or prepared based on the formulations disclosed in Table 1 and method 100 disclosed in FIG. 1. The formulations of the two-phase structured lubricant of desirable properties are chosen for the particular system. The system may be any assembly system of lubricated engineering components, such as a combustion engine, a manual transmission system, an automatic transmission system, a transfer case (in a vehicle), a differential gear system, a gear system, electric vehicle, an electric vehicle transmission system, etc.

Method 300 includes applying the two-phase structured lubricant to assemble the system (step 304). The two-phase structured lubricant is applied during assembly process of the system to provide lubrication and help the assembly process.

Method 300 includes applying a standard lubricant to the assembly system (step 306). Once the system is assembled (ready for operation), a standard lubricant is applied to the system to displace the two-phase structured lubricant. The standard lubricant refers to the lubricant conventionally used to provide lubrication during the operation the system (e.g., the system assembled using the two-phase structured lubricant disclosed herein). The two-phase structured lubricants disclosed herein are designed to have characteristics and/or properties that allow for the rapid displacement of the lubricant by the standard lubricant present in the system.

What is claimed is:

1. A two-phase structured lubricant, comprising:

a liquid component about 5% by weight (wt. %) to 79 wt. %; and a structural component about 21 wt. % to 95 wt. %, wherein the structural component recrystallizes or solidifies around the liquid component.

2. The two-phase structured lubricant of claim 1, wherein the liquid component is about 70 wt. % to 79 wt. % and comprises lubricant oil, and the structural component is about 21 wt. % to 30 wt. % and comprises wax.

3. The two-phase structured lubricant of claim 2, comprising one or more properties comprising:

ASTM D217 test result of 215 mm/10;

ASTM D217 60 stroke result of 425 mm/10; and

ASTM D1831 test result of liquid.

4. The two-phase structured lubricant of claim 2, comprising one or more properties comprising:

ASTM D2266 wear scar=0.39 mm;

ASTM D2596 last nonseizure load=63 kg;

ASTM D2596 weld load=200 kg;

ASTM D5706 pass load=2000 N; and

ASTM D7594 wear scar/cof=0.486 mm/0.128.

5. The two-phase structured lubricant of claim 2, comprising one or more properties when the two-phase structured lubricant is tested when diluted by a standard electrical vehicle transmission fluid at a ratio of the two-phase structured lubricant: the standard electrical vehicle transmission fluid =1:50 parts, wherein the properties comprise:

HERR coefficient of friction=0.106;

HERR wear scar area=11242 $mm^2$;

ASTM D2266 wear scar=0.459 mm; and electrical conductivity at 25° C.=6000 pS/cm.

6. The two-phase structured lubricant of claim 1, wherein the liquid component is about 5 wt. % to 25 wt. % and comprises lubricant oil, and the structural component is about 75 wt. % to 95 wt. % and comprises petrolatum.

7. The two-phase structured lubricant of claim 6, comprising one or more properties comprising:

ASTM D217 test result of 220 mm/10;

ASTM D217 60 stroke result of 235 mm/10;

ASTM D1831 test result of 266.5 mm/10; and

Melting point=40° C.

8. The two-phase structured lubricant of claim 6, comprising one or more properties comprising:

ASTM D2266 wear scar=0.43 mm;

ASTM D2596 last nonseizure load=126 kg;

ASTM D2596 weld load=200 kg;

ASTM D5706 pass load=2000 N; and

ASTM D7594 wear scar/cof=0.562 mm/0.119.

9. The two-phase structured lubricant of claim 6, comprising one or more properties when the two-phase structured lubricant is tested when diluted by a standard electrical vehicle transmission fluid at a ratio of the two-phase structured lubricant: the standard electrical vehicle transmission fluid=1:50 parts, wherein the properties comprise:

HERR coefficient of friction=0.128;

HERR wear scar area=22066 $mm^2$;

ASTM D2266 wear scar=0.51 mm; and electrical conductivity at 25° C.=6800 pS/cm.

10. The two-phase structured lubricant of claim 1, further comprising a balance of an additive and/or a colorant.

11. A method of making a two-phase structured lubricant, comprising:

mixing and heating a liquid component and a structural component, wherein the liquid component is about 5 wt. % to 79 wt. % of the two-phase structured lubricant;

mixing a structured component with the heated liquid component, wherein and the structural component is about 21 wt. % to 95 wt. % of the two-phase structured lubricant;

melting the structural component and mixing with the liquid component to form a homogenous mixture; and cooling the homogeneous mixture to form the two-phase structured lubricant.

12. The method of claim 11, comprising mixing an additive and/or a colorant to the homogenous mixture.

13. The method of claim 11, comprising mixing the liquid component and the structural component at about 400 revolutions per minute (rpm) to 1000 rpm.

14. The method of claim 11, comprising heating the liquid component to a temperature equal to or about 1 degree Celsius (° C.) to 10° C. higher higher than the melting temperature of the structural component.

15. The method of claim 14, wherein the melting temperature of the structural component is about 45° C. to 125° C.

16. The method of claim 14, wherein the melting temperature of the structural component is about 20° C. to 100° C.

17. The method of claim 11, comprising heating the liquid component first, and then mixing the structural component with the heated liquid component at about 400 rpm to 1000 rpm.

18. The method of claim 11, comprising cooling the homogeneous mixture at a cooling rate of about 1 degree Celsius per minute (° C./min) to 5° C./min.

19. A method of assembling a system using a two-phase structured lubricant, comprising:

applying the two-phase structured lubricant during assembling of the system, wherein the two-phase structured lubricant comprises:

a liquid component about 5% by weight (wt. %) to 95 wt. %; and a structural component about 5 wt. % to 95 wt. %, wherein the structural component recrystallizes or solidifies around the liquid component; and after the system is assembled, applying a standard lubricant to displace the two-phase structured lubricant from the assembled system.

20. The method of claim 19, wherein the system is a combustion engine, a manual transmission system, an automatic transmission system, a transfer case in a vehicle, a differential gear system, a gear system, electrical vehicle, or an electrical vehicle transmission system.

* * * * *